US010704326B2

(12) United States Patent
St. Godard

(10) Patent No.: US 10,704,326 B2
(45) Date of Patent: Jul. 7, 2020

(54) SYSTEM FOR SUPPORTING A LADDER IN UPRIGHT ORIENTATION

(71) Applicant: Douglas Eric St. Godard, Winnipeg (CA)

(72) Inventor: Douglas Eric St. Godard, Winnipeg (CA)

(73) Assignee: Doug St. Godard, Winnipeg, Manitoba (CA)

( * ) Notice: Subject to any disclaimer, the term of this patent is extended or adjusted under 35 U.S.C. 154(b) by 0 days.

(21) Appl. No.: 15/729,763

(22) Filed: Oct. 11, 2017

(65) Prior Publication Data

US 2018/0128050 A1 May 10, 2018

Related U.S. Application Data

(60) Provisional application No. 62/437,153, filed on Dec. 21, 2016.

(51) Int. Cl.

| | |
|---|---|
| ***E06C 7/48*** | (2006.01) |
| ***E06C 9/12*** | (2006.01) |
| *E06C 1/04* | (2006.01) |

(52) U.S. Cl.

CPC ..... *E06C 7/48* (2013.01); *E06C 9/12* (2013.01); *E06C 1/04* (2013.01)

(58) Field of Classification Search

CPC ..... E06C 7/48; E06C 9/06; E06C 9/08; E06C 9/12; E06C 1/04

See application file for complete search history.

(56) References Cited

U.S. PATENT DOCUMENTS

| | | | | | |
|---|---|---|---|---|---|
| 276,815 | A * | 5/1883 | Heidel | A62B 35/0087 | 182/36 |
| 278,310 | A * | 5/1883 | Bierbach | A62B 35/0087 | 182/36 |
| 383,449 | A * | 5/1888 | Eiden | E06C 9/12 | 182/13 |
| 426,983 | A * | 4/1890 | Coburn | E06C 9/12 | 182/39 |
| 451,158 | A * | 4/1891 | Mark | E06C 1/397 | 182/13 |
| 462,497 | A * | 11/1891 | Marshall | E06C 9/12 | 182/39 |

(Continued)

FOREIGN PATENT DOCUMENTS

| | | | | |
|---|---|---|---|---|
| CA | 2946941 | A1 * | 4/2018 | E06C 9/12 |
| DE | 1429814 | A1 * | 7/1969 | E06C 1/397 |

(Continued)

*Primary Examiner* — Katherine W Mitchell
*Assistant Examiner* — Candace L Bradford

(57) ABSTRACT

A ladder supporting device for supporting a ladder in upright orientation at an upright surface comprises a channel extending longitudinally from a first end to a second end arranged horizontally spaced across the upright surface with a backside facing the upright surface, a holding device located outside the channel distal to the upright surface, and at least one wheel rotatably supported on an axle connected to the holding device and passing into the channel which receives the at least one wheel such that the holding device is positionable longitudinally of the channel by rolling movement of the at least one wheel along the channel.

13 Claims, 3 Drawing Sheets

(56) References Cited

U.S. PATENT DOCUMENTS 463,217 A * 11/1891 Coburn ..... E06C 9/12 182/39
463,218 A * 11/1891 Coburn ..... E06C 9/12 182/38
521,381 A * 6/1894 Mallory ..... E06C 1/397 182/13
575,866 A * 1/1897 Wildprett ..... E06C 9/12 182/38
862,622 A * 8/1907 Eller ..... E06C 9/12 182/38
1,151,374 A * 8/1915 Moulton ..... E06C 9/12 188/42
1,188,991 A * 6/1916 Putnam ..... E06C 9/12 182/15
1,431,921 A * 10/1922 Barnes ..... E06C 1/397 188/42
1,450,430 A * 4/1923 Cornell ..... E06C 1/397 182/36
1,471,657 A * 10/1923 Hampton ..... E06C 1/397 188/42
1,515,420 A * 11/1924 Traylor ..... E06C 1/397 182/103
2,797,037 A * 6/1957 Niedojadlo ..... E06C 7/48 182/107
4,702,401 A * 10/1987 Graber ..... B60R 9/10 224/323
5,148,889 A * 9/1992 Fenwick ..... B65G 1/0492 182/115
5,480,002 A * 1/1996 Kerr ..... E06C 9/12 182/115
6,315,078 B1 * 11/2001 Kumher ..... E06C 5/02 182/127

FOREIGN PATENT DOCUMENTS

DE 3930484 A1 * 3/1991 ..... E06C 9/12
DE 202018101984 U1 * 5/2018 ..... E06C 1/36
FR 2904979 A1 * 2/2008 ..... E06C 1/397
GB 303687 A * 1/1929 ..... E06C 9/12
GB 606069 A * 8/1948 ..... E06C 1/397
GB 994025 A * 6/1965 ..... E06C 9/12
GB 1019275 A * 2/1966 ..... E06C 9/12
GB 2107379 A * 4/1983 ..... E06C 7/48

* cited by examiner

SYSTEM FOR SUPPORTING A LADDER IN UPRIGHT ORIENTATION

This application claims the benefit under 35 U.S.C. 119(e) of U.S. provisional application Ser. No. 62/437,153, filed Dec. 21, 2016, claims foreign priority benefits from Canadian Patent Application 2,946,941, filed Oct. 28, 2016.

FIELD OF THE INVENTION

The present invention relates to a system of components cooperating to support a ladder in an upright orientation and which is particularly but not exclusively suited for supporting the ladder at an upright surface such as that on an exterior of a building, for example a fascia of a house. This system is preferably arranged for positioning the ladder across the upright surface by rolling movement of wheels in a channel.

BACKGROUND

It may be desirable to have a novel system for supporting a ladder in upright orientation that is particularly but not exclusively suited for operation at an upright surface such as a fascia of a house.

SUMMARY OF THE INVENTION

According to an aspect of the invention there is provided a ladder supporting system for supporting a ladder in upright orientation at an upright surface comprising:

a channel extending longitudinally from a first end to a second end arranged horizontally spaced across the upright surface and first and second sides spanning longitudinally from the first end to the second end;

the channel having a backside arranged to face towards the upright surface and an opposite front side arranged to be distal to the upright surface;

a holding device located outside the channel adjacent the front side arranged for attaching to the ladder;

at least one wheel rotatably supported on an axle connected to the holding device and passing into the channel which receives said at least one wheel such that the holding device is positionable longitudinally of the channel by rolling movement of said at least one wheel along the channel;

wherein the channel is substantially circumferentially enclosed such that the axle passes through a slot in the front side of the channel extending longitudinally of the channel and walls of the channel on either side of the slot confine said at least one wheel to the channel.

For example each one of the walls may extend from the backside of the channel to an edge in front of said at least one wheel so as to include a portion disposed intermediately the respective wheel and the holding device in a horizontally transverse direction relative to the channel. That is, said edge of the respective wall is located in front of a face of said at least one wheel which is adjacent the front side of the channel.

Typically the backside of the channel defines a plane.

In one arrangement there is provided a flange oriented parallel to said plane extending transversely from the channel to a longitudinally extending edge spaced from the first side of the channel.

This flange provides a mounting surface alongside the channel. For example when the channel is mounted at a fascia of the house defining the upright surface, an eavestrough or gutter may be mounted at the flange above the channel.

Preferably the holding device is arranged to fasten the ladder at a prescribed angle transverse to a plane containing a wheel axis defined by the axle.

As such, preferably the wheel axis is maintained horizontal and the prescribed angle is inclined relative to the horizontal.

Typically there is provided a brake for locking the holding device in fixed location along the channel.

In one arrangement the brake is formed by a clamping member carried outside the channel and displaceable axially of each of said at least one wheel into a position at an exterior surface of a wall portion of the channel so as to clamp with a face of said at least one wheel the wall portion of the channel.

The wall portion may be defined by one or both of the walls having an edge in front of the front side face of said at least one wheel.

According to another aspect of the invention there is provided a ladder supporting system for supporting a ladder in upright orientation at an upright surface comprising:

a channel extending longitudinally from a first end to a second end arranged horizontally spaced across the upright surface and first and second sides spanning longitudinally from the first end to the second end;

the channel having a backside arranged to face towards the upright surface and an opposite front side arranged to be distal to the upright surface;

wherein the backside defines a plane;

a holding device located outside the channel adjacent the front side arranged for attaching to the ladder;

at least one wheel rotatably supported on an axle connected to the holding device and passing into the channel which receives said at least one wheel such that the holding device is positionable longitudinally of the channel by rolling movement of said at least one wheel along the channel;

and a flange extending transversely from the channel to a distal edge spaced from the first side of the channel defining therebetween a mounting surface alongside the channel;

the flange lying in said plane of the backside of the channel so as to be oriented parallel to the channel such that the flange and backside of the channel are in a position for abutting the upright surface.

Typically the flange is oriented with the distal edge above the channel so as to provide the mounting surface vertically thereabove.

For example there is provided an eavestrough mounted at the flange extending longitudinally of the channel.

Typically the eavestrough is mounted directly at the upright surface which in this example is defined by a fascia of a house.

Thus the channel with flange is mounted at the fascia before mounting of the eavestrough. Then, the eavestrough is mounted at the mounting surface so as to be in front of the flange and above the channel. In this manner the channel is arranged to be tucked in beneath the eavestrough which is a commonplace feature of houses.

In this arrangement the holding device supports the ladder at a location spaced transversely from the channel in a manner so that the ladder oriented at the prescribed angle may vertically clear the eavestrough as otherwise in this prescribed angle the ladder is intersecting an upright plane in which the channel and flange lie.

In one arrangement the channel and flange collectively are formed from a first sheet shaped so as to form at one side thereof a hook extending in a longitudinal direction of the channel and at a transversely opposite side the first sheet defining the mounting surface, and a second sheet coupled at a face of the first sheet which defines the mounting surface and shaped so as to form a first section extending longitudinally of the channel in abutment with the said face of the first sheet and a second section extending from said face of the first sheet to a free edge spaced therefrom such that the channel is defined between the second section of the second sheet and the hook of the first sheet.

For example the first section of the second sheet is fastened to the first sheet by a plurality of rivets or spot welds at longitudinally spaced positions.

Typically the flange is sized so that the first section of the second sheet is covered by the eavestrough thereby concealing locations at which the first sheet is fastened to the first sheet.

This is an alternative to having the channel and flange formed by an extrusion process by which they would form a unitary component.

According to a further aspect of the invention there is provided a ladder supporting system for supporting a ladder in upright orientation at an upright surface comprising:

a channel extending longitudinally from a first end to a second end arranged horizontally spaced across the upright surface and first and second sides spanning longitudinally from the first end to the second end;

the channel having a backside arranged to face towards the upright surface and an opposite front side arranged to be distal to the upright surface;

a holding device located outside the channel adjacent the front side arranged for attaching to the ladder;

at least one wheel rotatably supported on an axle connected to the holding device and passing into the channel which receives said at least one wheel such that the holding device is positionable longitudinally of the channel by rolling movement of said at least one wheel along the channel;

a brake for locking the holding device in fixed location along the track formed by a clamping member carried outside the channel and displaceable axially of each of said at least one wheel into a position at an exterior surface of the channel so as to cooperate with a face of said at least one wheel to clamp a wall of the channel defining said exterior surface.

In one arrangement the clamping member comprises a plate threadably fastened against the exterior surface of the wall of the channel for braking.

The clamping member comprises a diameter of the order of that of said at least one wheel. Typically this diameter is measured at a clamping face of the member engaging the exterior surface of the channel. This may provide for even clamping on either side of the clamped element, that is the wall of the channel.

All or any set of the above features may be combined.

BRIEF DESCRIPTION OF THE DRAWINGS

An arrangement of the invention will now be described in conjunction with the accompanying drawings in which.

In the drawings like characters of reference indicate corresponding parts in the different figures.

DETAILED DESCRIPTION

Figure 1:
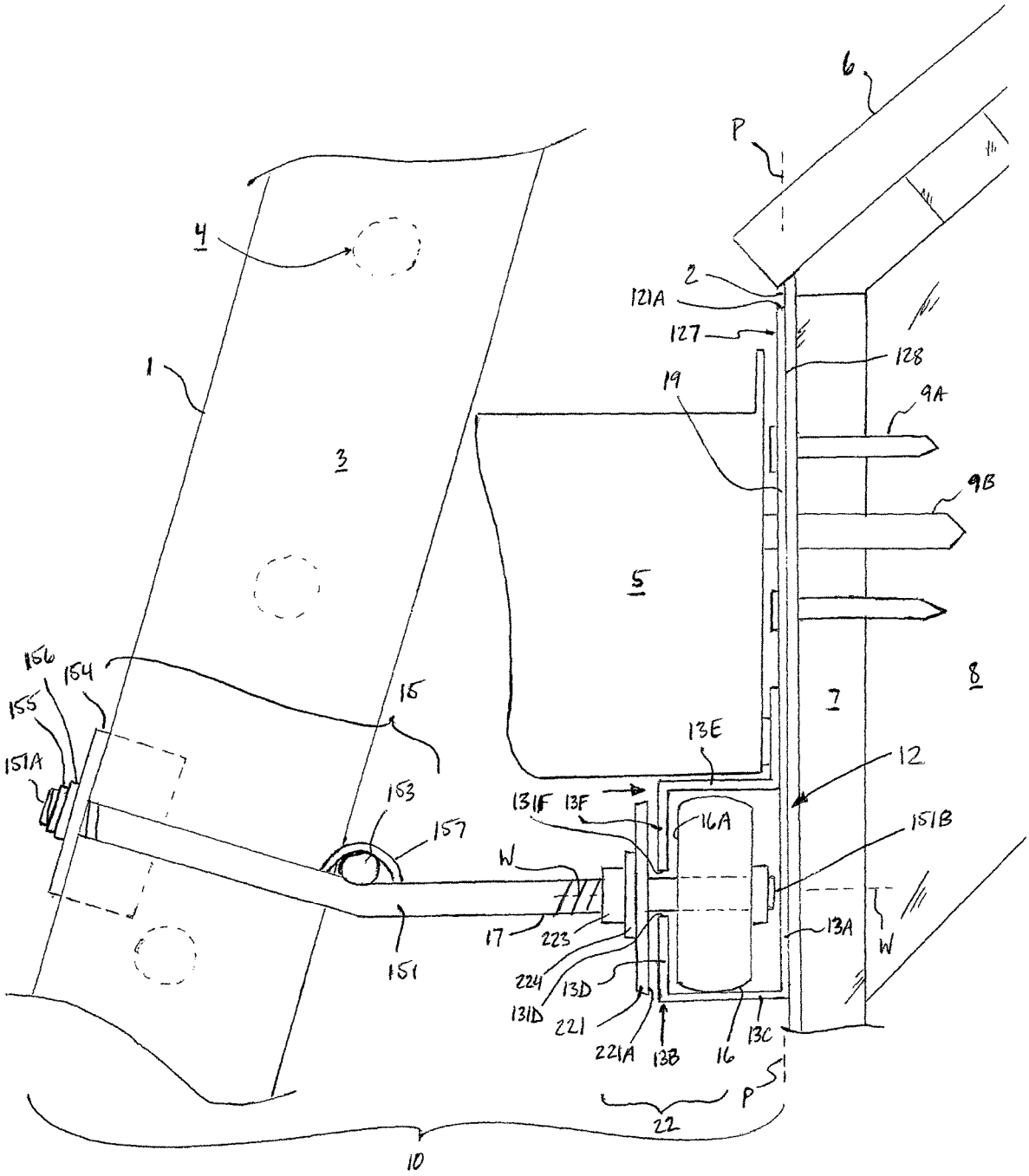
FIG. 1 is a schematic illustration in elevational view of a ladder supporting system according to the present invention where some components are omitted for clarity of illustration.
Figure 2:
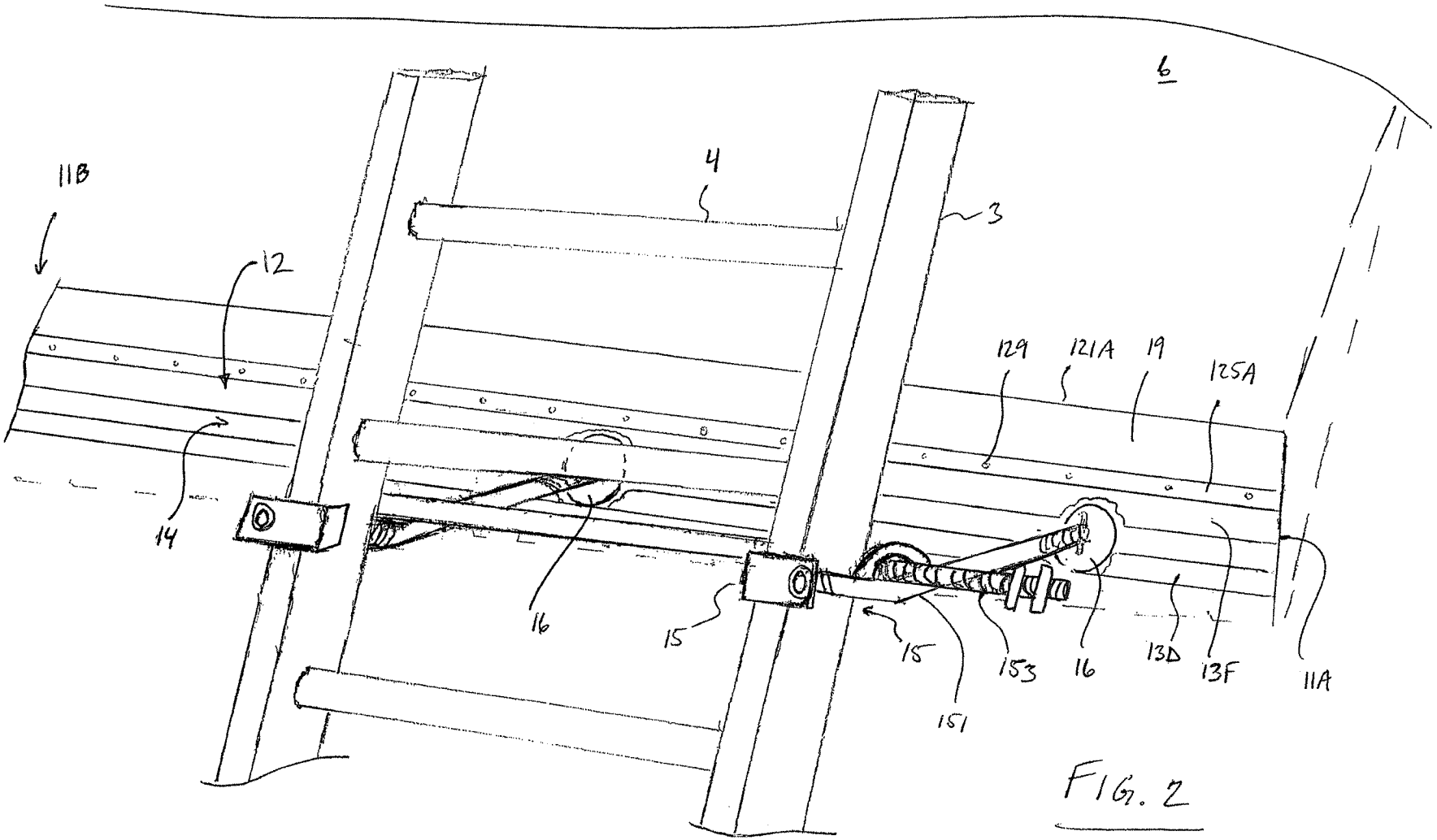
FIG. 2 is a perspective view of the ladder supporting system that is schematically illustrated in FIG. 1 where a channel of the system is cutaway for clarity of illustration.
Figure 3:
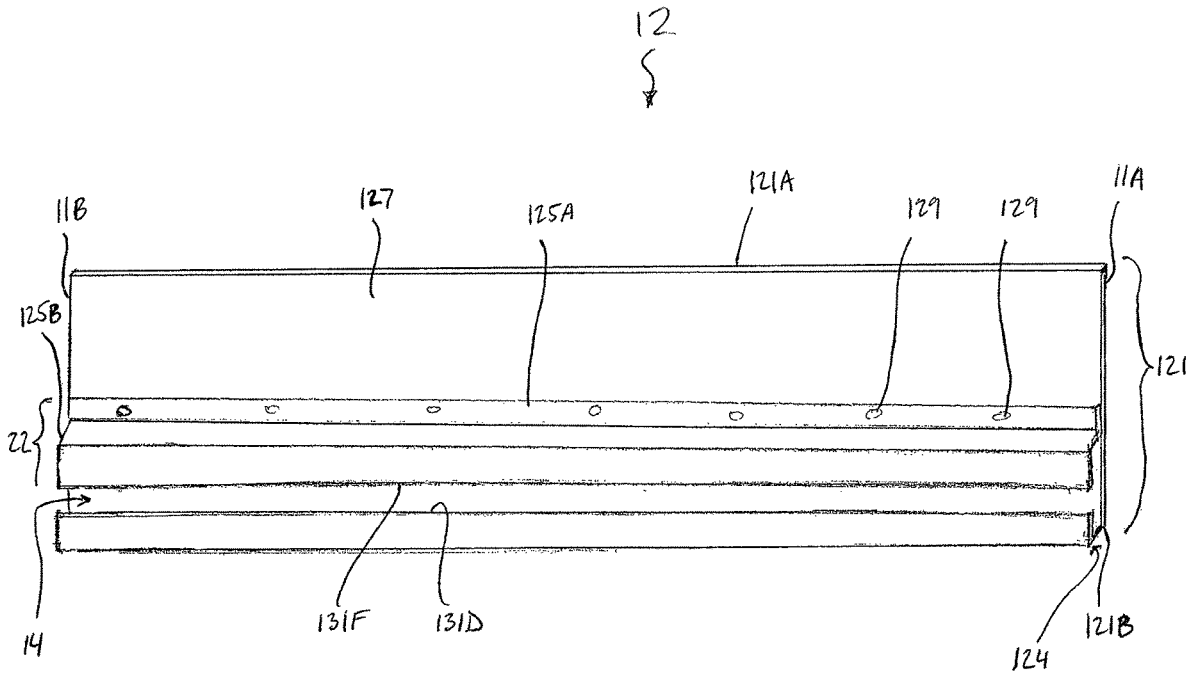
FIG. 3 illustrates the channel and a flange of the system as depicted in the earlier figures.

There is illustrated in the figures a system which is generally indicated at 10 for supporting a ladder 1 in upright orientation at an upright surface 2. The conventional ladder 1 comprises a pair of rails 3 extending longitudinally of the ladder with a plurality of rungs 4 spanning laterally between the rails at longitudinally spaced positions. For climbing it is preferred that the ladder is positioned at a prescribed angle relative to the vertical, as known by a person skilled in the art.

The system 10 of the illustrated arrangement is particularly suited for application at an exterior surface of a building such as a house, and more specifically at a fascia of the house as conventionally understood where typically an eavestrough 5 is mounted at an edge of a roof 6 of the house.

Typically the fascia comprises a covering 2 on a fascia board 7 having a pair of wider faces spaced apart by a thickness of the board and a pair of narrower faces spaced apart by a width of the board. The fascia board 7 is oriented so that its wider faces are substantially vertical with one of the narrower faces at a top and an opposite one of the narrower faces at a bottom, and thus the covering 2 is attached at an outer one of the wider faces. The fascia board is fastened to trusses 8 (schematically shown) forming the roof 6 that meet the board substantially at right angles to an inner one of the wider faces.

The system 10 generally comprises a channel 12 extending longitudinally from a first end 11A to a second end 11B arranged horizontally spaced across the upright surface defined by the fascia 2 with a backside 13A of the channel defining a plane P positioned against the fascia; a holding device 15 located outside the channel arranged for attaching to the ladder 1; and at least one wheel 16 rotatably supported on a respective axle 17 connected to the holding device 15 and passing into the channel 12 wherein the respective wheel is received for rolling movement therealong so that the holding device may be positioned at various locations longitudinally of the channel. The system also includes a flange 19 oriented parallel to the backside 13A of the channel and extending from the channel in a transverse direction to a longitudinally extending distal edge 121A spaced from one side 13E of the channel. As such between the distal edge 121A of the flange and the side 13E of the channel there is provided a mounting surface suitable for mounting the eavestrough 5 above the channel.

The channel 12 of the illustrated arrangement is formed by two sheets of metal 121 and 122 each shaped so as to define part of the channel. A first one of the metal sheets 121 spans longitudinally so as to define the first and second ends 11A, 11B and transversely from a first side 121A to a second side 121B whereat is formed a hook 124 generally in the shape of a "J" along a full length of the first sheet. The first sheet of metal thus is substantially planar with exception of where the hook is formed. It forms the backside 13A of the channel which lies entirely in the plane P. The hook 124 formed of the first sheet defines a bottom wall 13C of the channel and a lower front wall 13D upstanding from the bottom wall spaced from the backside 13A and which terminates at an edge 131D spaced above the bottom wall.

A second one 122 of the sheets sized equally in length to the first sheet so as to span between the first and second ends 11A, 11B is coupled to the first sheet 121 at an intermediary location between the first and second sides 121A, 121B. A first section 125A of the second sheet where it is coupled to the first base sheet 121 lies flat against it so as to be in abutment with an outer surface 127 thereof. A second section 125B then extends from the outer surface 127 of the base sheet 121 to a free edge 131F spaced above the edge 131D of the lower front wall. The second section 125B forms a hook between the outer surface 127 of the base sheet and the free edge 131F such that the second sheet of metal is essentially zigzag-shaped. The second section 125B thus provides a top wall 13E of the channel and an upper front wall 13F depending therefrom spaced from the backside 13A and terminating at the edge 131F. It is the lower and upper front walls 13D and 13E which collectively form a front side 13B of the channel opposite the backside 13A.

As such, the channel 12 is formed collectively by a lower portion of the first sheet of metal 121 including the hook 124 and the second section 125B of the second sheet of metal 122. The flange 19 is formed by an upper portion of the first base sheet 121 extending transversely inwardly in a downward direction from the first side 121A defining the distal edge of the flange towards the second section 125B of the second sheet.

At the first section 125A the second sheet of metal is attached to the first sheet 121 of metal by for example a plurality of rivets or spot welds indicated at 129 at longitudinally spaced positions (longitudinal direction of the channel).

A base of the ladder supporting system which is formed by the flange 19 and channel 12 is affixed to the upright surface 2 by fasteners 9A such as screws passed through the flange 19 and into each of the fascia board 7 and trusses 8. An inner surface 128 of the first sheet 121 of metal is thus placed in abutment with the fascia 2, and as such both the flange 19 and backside 13A of the channel 12 are abutting the upright surface.

The flange 19 is therefore mounted at the fascia 2 before mounting of the eavestrough 5. After the flange 19 with channel 12 have been installed at the fascia, the eavestrough 5 is mounted with fasteners 9B passed through a backside of the eavestrough and the flange and into the fascia board and trusses in position at the mounting surface of the flange that is defined by the outer surface 127 of the first base sheet 121 such that the eavestrough is in front of the flange and above the channel 12. The flange is sized so that the eavestrough 5 covers an area on the flange between the distal edge 121A of the flange and the top wall 13E of the channel such that the eavestrough conceals both the fasteners 9A passed through the flange 19 and the rivets/spot welds at the first section 125A of the second sheet which typically are visible. In this manner the channel is arranged tucked in beneath the eavestrough which visually dominates the arrangement of flange and channel, the latter of which is sized smaller particularly in depth from the outer surface 127 at the flange 19.

The holding device 15 of the illustrated arrangement comprises a pair of arms formed by rods 151 spaced from one another in a longitudinal direction relative to the channel. Each rod at one end where the rod passes into the channel 12 forms the axle 17 on which one of two wheels of the illustrated arrangement is rotatably supported. The axles 17 each defining a wheel axis W of the respective wheel are oriented perpendicularly transversely to the channel so as to extend radially therefrom.

Thus the holding device which is formed at ends 151A of the arms 151 opposite the axles 17 in a manner such that the axles and holding device are connected is located distal to the channel adjacent the front side 13B thereof.

Adjacent the distal ends 151A of the arms there is provided a clamp of the holding device for clamping at the rails of the ladder. The clamp is collectively formed by a bar 153 interconnecting the arms 151 at a fixed intermediary location therealong and spaced from the bar 153 closer to the distal ends 151A is provided a L-shaped bracket 154 on each arm that wraps about the respective rail 3 from a front to an inside thereof with the respective arm being located outwardly of that ladder rail. Each L-shaped bracket 154 is displaceable along the respective arm 151 and can be located fixedly in abutment with the respective ladder rail by a threaded nut 155 and a leading lock washer 156 so as to fit on the holding device ladders having different rail widths. Additionally a spacing between the arms 151 may be adjusted to fit ladders having different widths from one rail to the other. In the illustrated arrangement the bar 153 is affixed to one of the arms and is threadably carried by an upstanding ear 157 with an aperture on the other arms to provide this adjustability of the holding device accommodating different widths of ladder.

The arms 151 follow a non-linear path from the ends forming the axles to the ends 151A distal to the channel 12 such that there is a bend in each of the arms at an intermediary location therealong which in the illustrated arrangement registers with location of the interconnecting bar 153. By this bend the distal end 151A of the respective arm is located above the wheel axis W. As such the ladder when clamped between the L-shaped brackets and the bar may be supported at the prescribed angle and the wheel axles 17 maintained horizontal.

An end 151B of the respective arm which is located inside the channel is capped for example by threaded nut and washer so as to prevent the respective wheel 16 from being removed from the axle. There may also be included at this end a cover adjacent the wheel sized so as to cover an inner structure of the wheel (for example interior bearings) and thus prevent debris or dust from entering same. On an opposite side of the respective wheel from the capped end 151A, at a front side face 16A of the wheel, the front side 13B of the channel is shaped to retain the wheel within the channel, where in the illustrated arrangement both front walls 13D and 13F are provided therefor. Generally speaking the channel walls including the front ones 13D and 13F, top 13E, and bottom 13C cooperative to confine said at least one wheel to the channel. Thus the channel is substantially enclosed so that the axle 17 passes through a slot 14 in the front side 13B of the channel extending longitudinally of the channel which in the illustrated arrangement is defined between opposite edges 131D and 131F of the front walls.

Further to those features of the system 10 already described above, the system includes a brake 22 for locking the holding device in fixed location device along the channel 12 forming a track for the wheels 16.

The brake 22 one of which is provided at each wheel is formed by a clamping member 221 carried outside the channel 12 and displaceable axially of the respective wheel 16 into a position at an exterior surface of the front walls 13D, 13F of the channel each of which have an edge adjacent and in front of the wheel's front side face 16A. Thus when the clamping member with its channel wall engaging surface 221A is displaced along the axle so as to be brought into abutment with the channel's exterior surface the wheel may be drawn towards the front side 13B of the channel if it is spaced therefrom so that the channel walls at the front side are clamped between the clamping member at its wall engaging surface 221A and the wheel at its front side face 16A. In the illustrated arrangement the clamping member 221 comprises a plate in the form of a washer sized so as to be substantially equal in diameter to the wheel 16 that is threadably sandwiched against the exterior surface of the front side walls of the channel for example with a series of a threaded nut 223, and a lock washer 224. For example the clamping member may be a stop washer having a face distal the clamping face that has a smaller diameter and which is trailed by a flat washer disposed thereafter but leading the lock washer 224.

In use the ladder 1 once attached into the holding device 15 is positioned where desired at the upright surface by movement in directions parallel thereto by a user. The at least one wheel 16 in the channel 12 guides this movement of the ladder across the upright surface. Bottoms of the ladder are rested at the ground or that support surface beneath the ladder for climbing the ladder. When it is desired to lock the location of the ladder the clamping member 221 is moved into position against the exterior surface of the channel at the front walls 13D, 13F and tightened in position thereagainst by the series of fasteners trailing the plate on the axle, by which the wheel on the other side of the walls is tightened in position against the front walls of the channel. As shown in the accompanying figures and described above, the ladder supporting system is mounted on the exterior mounting surface of a building comprising a fascia board supporting an eavestrough thereon such that the backside sheet of the channel extending above the top wall of the channel that defines a mounting flange is secured to the building against the fascia board of the building using fasteners and such that the eavestrough is fastened to the fascia board so as to extend over mounting flange and so as to conceal the fasteners that secure the mounting flange to the building. The channel shown in the figures includes a backside sheet mounted against the external mounting surface of the building, a bottom wall protruding from the backside sheet, a lower front wall extending upwardly from the bottom wall at a location spaced outwardly from the backside sheet, a top wall protruding from the backside sheet above the bottom wall, and an upper front wall extending downwardly from the top wall so as to define a longitudinal slot in the channel at a front side of the channel opposite from the backside sheet between the upper and lower front walls. The holding device accepts various sizes of ladders by being formed of two arms extending outwardly of the channel from respective inner ends supporting respective wheels of the wheels assembly thereon within the channel to respective outer ends supporting the two brackets respectively thereon with a bar 153 extending across a rear side of the ladder that is connected to the two arms. The two arms on the crossbar are adjustable to clamp the ladder of various widths therebetween. The brackets are mounted on the bar 153 so as to be arranged to receive different sizes of rails clamped therein in addition to the two brackets being adjustable in spacing relative to one another in the longitudinal direction of the channel so as to be arranged to receive different widths of ladders in the holding device. The bar 153 extends across a rear side of the ladder between the two arms in engagement with the rear side of the ladder. The wheel assembly in the illustrated embodiment includes one wheel rotatably supported at an inner end of each arm such that a spacing between the wheels is adjustable with the spacing between the two arms. The brake associated with each wheel for locking the holding device at a fixed location along the channel includes a clamping member carried outside the channel that is movable relative to the wheel in a direction of an axis of rotation of the wheel into a braking position in which the clamping member is in clamping engagement with an exterior surface of the channel to lock the holding device at the fixed location along the channel. In the braking position, the clamping member is clamped against the exterior surface of the channel in alignment with the corresponding wheel in the braking position. As further shown in the drawings, the outer end of each arm that supports the bracket thereon is angularly offset from the inner end supporting the wheel thereon corresponding to the prescribed angle from vertical.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A ladder supporting system in combination with a building having an exterior mounting surface and in combination with a ladder comprising two rails and a plurality of rungs spanning between the rails at spaced positions for supporting the ladder in an upright orientation relative to the exterior mounting surface at a prescribed angle from vertical, the system comprising:

a channel mounted to extend in a longitudinal direction of the channel horizontally across the external mounting surface of the building, the channel comprising a backside sheet mounted against the external mounting surface of the building, a bottom wall protruding from the backside sheet, a lower front wall extending upwardly from the bottom wall at a location spaced outwardly from the backside sheet, a top wall protruding from the backside sheet above the bottom wall, and an upper front wall extending downwardly from the top wall so as to define a longitudinal slot in the channel at a front side of the channel opposite from the backside sheet between the upper and lower front walls;

a wheel assembly comprising a plurality of wheels supported within the channel such that the wheels are confined within the channel and such that the wheel assembly is movable in the longitudinal direction of the channel by rolling movement of the wheels along the channel;

a holding device located outside the channel and adjacent to the front side of the channel, the holding device being connected to the wheel assembly through the longitudinal slot in the front side of the channel such that the holding device is movable in the longitudinal direction of the channel together with the wheel assembly;

the holding device comprising:

(i) two arms, each arm extending outwardly of the channel from an inner end of the arm supported on the wheel assembly within the channel to an outer end of the arm at an exterior of the channel;

(ii) two brackets supported on the outer ends of the two arms respectively; and (iii) a bar connected to the two arms, the bar extending across a rear side of the ladder between the two rails of the ladder and the bar engaging the rear side of the ladder;

each bracket being movable relative to the respective arm and being operable to receive a respective one of the two rails of the ladder fixedly clamped therein such that the ladder is clamped between the bar and the two brackets and such that the ladder is supported at the prescribed angle from vertical.

2. The ladder supporting system according to claim 1 wherein the two brackets are able to be fixed relative to the ladder so as to be arranged to receive different sizes of rails clamped therein.

3. The ladder supporting system according to claim 1 wherein the two brackets are adjustable in spacing relative to one another in the longitudinal direction of the channel so as to be arranged to clamp different widths of ladders in the holding device.

4. The ladder supporting system according to claim 1 wherein the bar is mounted to the two arms such that a spacing between the two arms is adjustable in the longitudinal direction of the channel so as to be arranged to clamp different widths of ladders in the holding device.

5. The ladder supporting system according to claim 1 wherein the wheel assembly comprises one wheel rotatably supported at an inner end of each arm.

6. The ladder supporting system according to claim 5 wherein the bar is mounted to the two arms such that a spacing between the two arms is adjustable in the longitudinal direction of the channel so as to be arranged to clamp different widths of ladders in the holding device and wherein a spacing between the wheels is adjustable together with adjustment of the spacing between the two arms.

7. The ladder supporting system according to claim 1 wherein the ladder supporting system further comprises a brake associated with one of the wheels for locking the holding device at a fixed location along the channel, said at least one brake comprising a clamping member carried outside the channel and being movable relative to said one of the wheels in a direction of an axis of rotation of the wheel into a braking position in which the clamping member is in clamping engagement with an exterior surface of the channel to lock the holding device at the fixed location along the channel.

8. The ladder supporting system according to claim 7 wherein the clamping member is movable into the braking position in a direction of an axis of rotation of said one of the wheels.

9. The ladder supporting system according to claim 7 wherein the clamping member is clamped against the exterior surface of the channel in alignment with said one of the wheels in the braking position.

10. The ladder supporting system according to claim 1 further comprising:

the exterior surface of the building comprising a fascia board supporting an eavestrough thereon;

the backside sheet of the channel extending above the top wall of the channel to define a mounting flange secured to the building against the fascia board of the building using fasteners; and the eavestrough being fastened to the fascia board so as to extend over mounting flange and so as to conceal the fasteners that secure the mounting flange to the building.

11. A ladder supporting system for supporting a ladder in an upright orientation at an upright surface, the system comprising:

a channel extending in a longitudinal direction from a first end to a second end and arranged to be mounted to extend horizontally across the upright surface, the channel having a backside sheet arranged to be mounted directly against the upright surface and an opposite front side arranged to be distal to the upright surface;

a wheel assembly comprising a plurality of wheels supported within the channel such that the wheels are confined within the channel and such that the wheel assembly is movable in the longitudinal direction of the channel by rolling movement of the wheels along the channel;

a holding device located outside the channel and adjacent to the front side of the channel, the holding device being connected to the wheel assembly so as to be movable in the longitudinal direction of the channel together with the wheel assembly;

at least one brake associated with a respective one of the wheels for locking the holding device at a fixed location along the channel, said at least one brake comprising a clamping member carried outside the channel on an axle of the respective one of the wheels and being movable along the axle relative to the respective one of the wheels in a direction of an axis of rotation of the wheel into a braking position in which the clamping member is in clamping engagement with an exterior surface of the channel and in which a portion of the channel is clamped between the clamping member and the wheel to lock the holding device at the fixed location along the channel.

12. The ladder supporting system according to claim 11 wherein the clamping member comprises a plate arranged to be threadably fastened against the exterior surface of the channel in the braking position.

13. The ladder supporting system according to claim 12 wherein the clamping member has a diameter which is approximately equal to a diameter of said at least one wheel.

* * * * *